United States Patent [19]

Brewer

[11] Patent Number: 4,684,036

[45] Date of Patent: Aug. 4, 1987

[54] CUP DISPENSING SYSTEM

[75] Inventor: Clarence T. Brewer, Oak Park, Ill.

[73] Assignee: Solo Cup Company, Urbana, Ill.

[21] Appl. No.: 797,874

[22] Filed: Nov. 14, 1985

[51] Int. Cl.[4] ..... B65G 59/10

[52] U.S. Cl. ..... 221/61; 221/63

[58] Field of Search ..... 221/33, 45, 61, 63, 221/44; 312/43

[56] References Cited

U.S. PATENT DOCUMENTS

| | | | |
|---|---|---|---|
| 1,043,854 | 11/1912 | Luellen | 221/63 |
| 1,891,542 | 12/1932 | Huff | 221/63 |
| 2,141,682 | 12/1938 | Carew | 221/44 |
| 2,170,105 | 8/1939 | Amberg | 221/63 |
| 2,584,941 | 2/1952 | Taubert | 221/45 |
| 4,094,443 | 6/1978 | Whelan | 221/63 |

*Primary Examiner*—F. J. Bartuska

*Attorney, Agent, or Firm*—Fitch, Even, Tabin & Flannery

[57] ABSTRACT

A cup dispensing system employs a housing having a pair of walls with relatively rigid inwardly inclined portions for supporting a stack of cups and enabling individual dispensing of cups.

15 Claims, 5 Drawing Figures

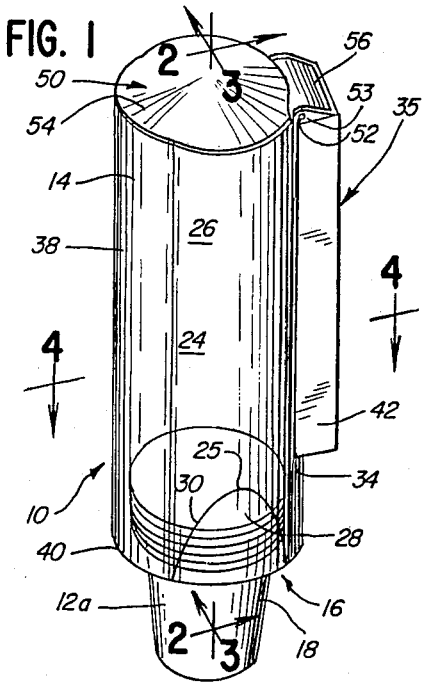
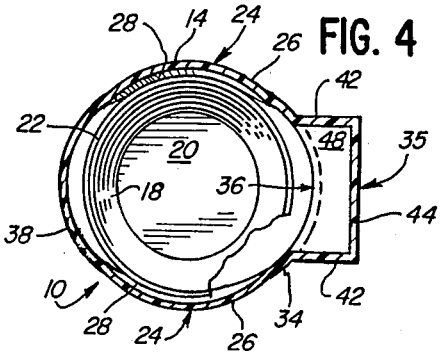
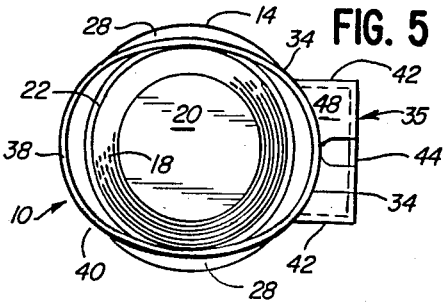
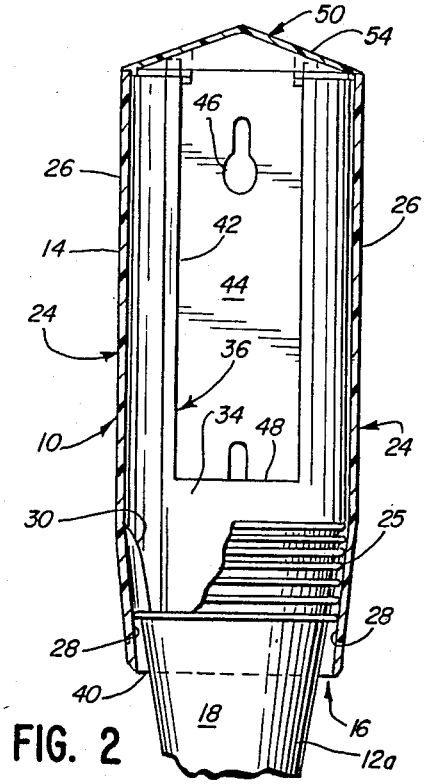
FIG. 2
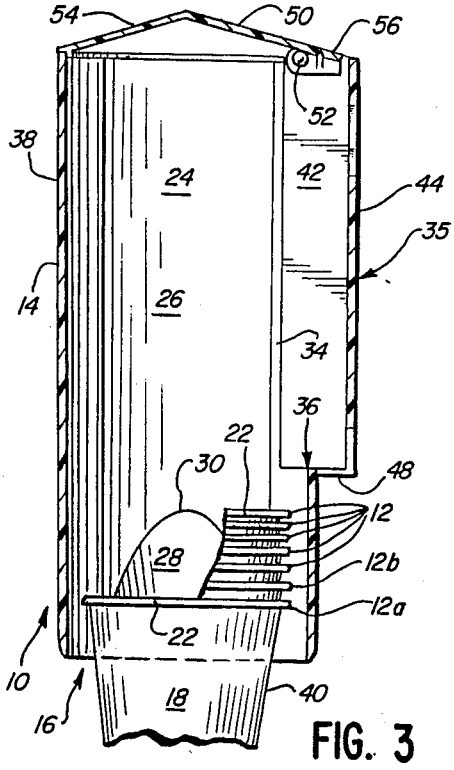
FIG. 3

CUP DISPENSING SYSTEM

BACKGROUND OF THE INVENTION

The invention relates to a dispensing system, and more particularly to a cup dispenser for supporting a stack of cups and releasing cups one at a time from the bottom of the stack.

Such dispensers generally are intended to provide support for the cups such that the bottom cup may be pulled downwardly and removed from the dispenser while the other cups remain supported therein. When a user grasps the bottom cup and pulls it downward, the bottom cup may deform so as to engage the side wall of the second cup from the bottom. This may result in substantial downward force on the second cup as the bottom cup is withdrawn. Additional downward force on the second cup may result from a partial vacuum between the bottom cup and the second cup if the bottom cup is pulled downward rapidly. The weight of the stack of cups may also place downward force on the second cup. These forces may prevent the bottom cup from separating from the stack freely, and may cause more than one cup to be dispensed when only a single cup is desired.

The downward force due to friction between the cups is partially dependent upon the magnitude of gripping force applied to the bottom cup, which is in turn partially dependent on the resistance to withdrawal of the bottom cup provided by the dispensing system. If the resistance to withdrawal is too great, a user will be likely to grip the bottom cup tightly when attempting to remove it, thus generating relatively high frictional forces between the side walls of the lower cups in the stack, and possibly withdrawing more than one cup. However, if the resistance to withdrawal is too low, then withdrawal of multiple cups can result from even relatively low gripping forces.

The downward force due to friction between the cups is also partially dependent on the interaction of the cups with the interior of the dispenser. The bottom cup may be deformed by the interior of the dispenser as it is drawn downwardly so that portions of the bottom cup are deflected inwardly to contact the second cup. The resultant frictional force will depend not only on the material of the cups and the inward force on the bottom cup, but also on the ability of the second cup to deform in response to the force exerted thereon by the bottom cup. The ability of the second cup to deform is a function of its own stiffness and of the stiffness of other cups contained therein. When the dispenser is nearly empty, containing, for example, only two or three cups, the second cup can deform much more readily than when the dispenser is full.

In the past, dispensers for plastic cups have generally employed resilient members such as brushes which engage the bottom cup to support the stack prior to withdrawal of the bottom cup, and which are sufficiently flexible that they can bend as the bottom cup is withdrawn, then spring back after the rim of the bottom cup has passed to engage the rim of the second cup. Such resilient members add to the cost of the dispenser, and may wear out.

Some prior art dispensers for use with paper cups have employed relatively rigid, inwardly extending flutes to deflect the cup rim inwardly at three or four points as the cup is withdrawn, but such dispensers have not been suitable for use with plastic cups, due largely to the greater stiffness of plastic cups.

It is a general object of the invention to provide an improved dispenser for one-by-one dispensing of plastic cups.

It is an additional object of the invention to provide a cup dispensing system employing a one-piece, molded housing for holding a stack of cups and controlling dispensing thereof.

Further objects and advantages of the invention are set forth below.

SUMMARY OF INVENTION

In accordance with the invention there is provided a dispenser comprising a pair of substantially rigid side walls having converging lower portions for supporting a stack of cups and enabling withdrawal of cups one by one from the dispenser. In the preferred embodiment, the side walls are part of a one-piece molded plastic housing. The housing is configured so that when a stack of cups is placed therein, the lower end of the bottom cup in the stack protrudes from an opening at the bottom of the housing. Downward movement of cups causes deformation of their rims from a generally circular configuration to a generally elliptical configuration. This provides interference between the cups and the interior of the housing, and provides resistance to prevent cups above the bottom cup from being withdrawn with the bottom cup.

BRIEF DESCRIPTION OF DRAWINGS

FIG. 1 is a perspective view of a cup dispensing system in accordance with the invention.

FIG. 2 is a sectional view, taken substantially along line 2—2 in FIG. 1 and looking in the direction of the arrows.

FIG. 3 is a sectional view, taken substantially along line 3—3 in FIG. 1 and looking in the direction of the arrows.

FIG. 4 is a transverse sectional view, taken substantially along line 4—4 in FIG. 1.

FIG. 5 is a bottom view of the dispensing system of FIG. 1.

DETAILED DESCRIPTION OF THE PREFERRED EMBODIMENT

The invention is generally embodied in a cup dispensing system 10 wherein a plurality of cups 12 are stacked in a housing 14 and supported therein so that they may be dispensed one at a time through an orifice 16 at the lower end of the housing 14. Each of the cups 12 herein has a substantially frustoconical side wall 18 extending upwardly from a circular bottom wall 20 and a circular bead or rim 22 extending about the upper edge of the side wall 18. In the preferred cup 12, the side wall 18 is inclined at an angle of 10° with respect to the axis of the cup over a major portion of its height, and is inclined at an angle of 13° with respect to the axis immediately beneath the rim. The rim 22 is formed by curling the upper edge of the cup outward, downward and upward so that the rim appears in cross-section as an arc of greater than 300°. The preferred cups 12 are made of a relatively stiff, resilient plastic.

Each cup 12 has a stacking shoulder of Z-shaped cross-section at its bottom so that when the cups are stacked, the bottom of each cup rests on the shoulder of the cup beneath it. The cups are configured so that when stacked in this manner, the side walls 18 of the respective cups 12 are spaced from one another, which facilitates separation. Cups of this type are referred to as "free nesting."

As noted above, dispensers for plastic cups have in the past frequently employed resilient members to support the cups. When the bottom cup is pulled downwardly, the resilient members bend or pivot to permit the bottom cup to pass. The present invention does not employ such deformable members, but rather relies on deformation of the cups themselves to permit them to be withdrawn from the supporting housing.

In accordance with the invention, the stack of cups 12 is supported by a pair of curved side walls 24 extending down opposite sides of the housing 14. Each side wall 24 has a substantially vertical upper portion 26 and an inwardly inclined, substantially rigid lower portion 28. The side walls 24 define a minor diameter for the interior of the housing 14 which is, along the upper portions 26 of the side walls 24, constant and slightly greater than the diameter of the cup rims 22, providing clearance between the upper portion of the stack and adjacent portions of the side walls 24 while limiting transverse movement of the upper portion of the stack.

The inclined lower portions 28 of the side walls 24 extend downwardly and inwardly so that the minor diameter decreases gradually toward the bottom of the housing 14, equaling the outer diameter of the cup rims at a predetermined point 25 above the bottom of the housing, and becoming smaller than the outer diameter of the cup rims 22 beneath the point 25. This provides interference between each cup rim 22 located beneath the point 25 and the interior surfaces of the inclined portions 28 so that removal of a cup 12 requires deformation thereof. The cup is deformed as it is pulled downwardly by a camming action due to sliding contact between the cup rim 22 and the inclined surfaces 28 at two diametrically opposed locations. For plastic cups, this is preferable to the action in dispensers where the cup rim is cammed inwardly at 3 or 4 evenly spaced locations as the cup is withdrawn.

The inclined lower portion 28 of each side wall 24 intersects the vertical portion 26 thereof along a coordinate curve 30 extending upward from the bottom of the housing 14. Each of the vertical portions 26 has a radius of curvature about a vertical axis. Each of the inclined lower portions 28 has a radius of curvature about an inclined, curved axis which radius is greater than the radius of curvature of the vertical portions 26 and greater than the undeformed radius of curvature of the cup rims 22.

As a cup 12 is pulled downwardly near the lower end of the housing 14, the interior surfaces of the inclined portions 28 deform the rim 22 of the cup 12 from its circular configuration to a generally elliptical configuration. The housing 14 is relatively rigid, and any deformation of the inclined surfaces 28 is minimal. The deformation of the rim 22 increases gradually with downward progress and is maximized just before the rim 22 reaches the lower edge 32 of the housing 14. The increasing deformation increases the outward force exerted on the housing 14 by the cup rim 22, which increases the upward reaction force opposing downward movement. At some point in the downward travel of the bottom cup **12*a*, the upward force on the second cup 12*b* exceeds the downward force, which enables separation of the bottom cup 12*a* from the second cup 12*b***.

Under some conditions, separation of the bottom cup **12*a* from the second cup 12*b* may occur immediately beneath the point 25 at which the interference between the interior of the housing and the rim of the second cup begins. Under other conditions, the entire stack may be drawn downwardly with the bottom cup 12*a* until the rim 22 of the bottom cup exits the lower end of the housing 14. In either case, the rim 22 of the bottom cup snaps back to its undeformed circular configuration as it travels beyond the lower edge 32 of the housing 14**.

An important feature of the invention is that the lower portions 28 of the side walls 24 are inclined at a smaller angle with respect to a vertical axis than are the side walls 18 of the cups. This prevents the deformation of the cups 12 by the inclined portions 28 from resulting in binding of the cups to one another. In the preferred embodiment, the lower portions of the side walls are inclined at about 6°, and, as noted above, each cup side wall is inclined at about 10°, except for a portion about 3/16 in. in height immediately beneath the rim, which is inclined at about 13°.

The above-described configuration enables the inclined surfaces 28 to engage and deflect gradually and progressively several cups at the bottom of the stack as they move downwardly, as illustrated in FIG. 2, which facilitates separation of the bottom cup **12*a*. The reduction in the minor diameter of each rim 22 as illustrated in FIG. 2, is accompanied by an increase in the major diameter thereof, as illustrated in FIG. 3**.

The side walls 24 of the housing 14 are supported in predetermined relation to one another by a back wall 34 which is in turn supported by a mounting structure 35. The back wall 34 has a radius of curvature about the vertical axis of the housing 14. Its radius of curvature is smaller than that of the undeformed cup rim 22. The back wall 34 has a generally vertical slot 36 formed therein extending along a major portion of its length from the top of the housing 14 to a point just above the upper ends of the inclined surfaces 28.

The housing 14 additionally includes a front wall 38 which is substantially symmetrical to the rear wall 34 except that it is not slotted. The front and rear walls are substantially vertical and define a major diameter for the housing 14 which is perpendicular to the minor diameter of the housing and which is greater than the major diameter of the cup rim 22 at its maximum deformation. The front and rear walls do not normally engage the cup rims 22, but they may engage the bottom of a cup side wall 18 in the event of a cup 12 being tilted with respect to the axis of the holder 14. The front and rear walls 38 and 34 cooperate with the side walls 24 to define a substantially elliptical bottom edge 40 of the housing 14 having a major diameter, defined by the front and rear walls, greater than the outer diameter of the cup rims 22, and a minor diameter, defined by the side walls 24, less than the outer diameter of the cup rims 22. The circumference of the bottom edge 40 is greater than that of the cup rims 22.

The mounting structure 35 in the illustrated embodiment includes a generally rectangular back wall 44 having an aperture 46 extending therethrough to facilitate attachment to a wall or other supporting surface. The back wall 44 of the mounting structure 35 is connected to the rear wall 34 of the tubular housing 14 by a pair of substantially parallel, generally trapezoidal side walls 42 and a horizontal bottom wall 48.

A pivotal lid 50 is provided at the upper end of the housing to restrict entry of foreign material. The lid 50 is supported on a pair of lugs or studs 52 extending into apertures 53 in the side walls 42 of the mounting structure 35. The lid 50 includes a sloped, generally conical wall 54 which is disposed forwardly of the studs 52 and which covers the tubular housing 14 and a sloped, generally rectangular tail 56 which is disposed rearwardly of the studs 52 and which covers a major portion of the mounting structure 35. The tail 56 is molded integrally with the conical wall 54, which makes it preferable to a separate cover piece which might alternatively be fixed across the top of the mounting structure 35. The spacing between the studs 52 and the rear surface of the back wall 44 is selected to enable the lid 50 to pivot upward enough to permit loading of cups without striking the wall supporting the dispenser. When the lid is opened, the tail 56 pivots downward and forward as the conical wall 54 pivots upward and rearward.

Each of the inclined portions 28 of the side walls 24 preferably has a height equal to about $\frac{2}{3}$ of the cup height. In the preferred embodiment, the inclined surfaces 28 are about 1.6 inches in height, and the cups are about 2.3 inches in height. The cup rims 22 in this embodiment have an outer diameter of about 2.4 inches, and the housing 14 has a minor diameter which decreases from about 2.5 inches to 2.2 inches along the inclined portions 28 of the side walls 24. Thus, in this embodiment, the decrease in the outer diameter of the cup rim 22 along the minor diameter of the housing 14 during the downward travel of the cup 12 through the lower end of the housing 14 is about 0.2 inches. The radius of curvature of the interior surfaces of the side walls 24 is about 1.24 inches along the upper portions of the side walls 24, and is about 1.7 inches along the inclined lower portions 28 of the side walls 24.

In the preferred embodiment, the tubular housing 14 and mounting structure 35 which make up the dispenser of the invention are manufactured as a one-piece unit by injection molding. To this end, all of the interior surfaces either are substantially vertical or face upwardly to permit the interior surfaces to be formed by a single core which can be withdrawn by upward movement of the core or downward movement of the dispenser. The exterior surfaces are formed by a pair of horizontally reciprocable mold halves. The apertures 46 and 53 are formed during molding. The lid 50 is also of one-piece, molded construction and is installed after molding by insertion of the studs 52 in the apertures. Thus, the dispenser may be manufactured simply and inexpensively. The dispenser is preferably made of polystyrene, and may be transparent to facilitate monitoring of the number of cups within the housing.

From the foregoing it will be appreciated that the invention described herein provides an improved and novel system for dispensing cups. The invention has been found to be particularly effective when used with thermoformed polypropylene cups. In the preferred embodiment described above, a cup may be withdrawn by application of downward force of about 6–8 oz. It is believed that 16–18 oz. of force is generally required for withdrawal of similar cups from previously known dispensers. The invention is not limited to the embodiment described above, or to any particular embodiment.

What is claimed is:

1. A drinking cup dispenser for supporting a stack of drinking cups and permitting withdrawal of said cups one at a time;

said dispenser comprising a substantially tubular housing having a continuously curved, substantially elliptic bottom edge;

said housing defining an interior having a pair of downwardly, gradually and progressively converging side wall portions to engage the stack at only two diametrically opposed locations so that said stack may be supported by engagement between said stack of cups and said downwardly converging side wall portions of said housing near said bottom edge of said housing.

2. A drinking cup dispensing system comprising a stack of plastic drinking cups and a one-piece, molded palstic housing for supporting said stack and releasing said cups individually;

each of said drinking cups having a substantially circular upper rim of predetermined outer diameter and each of said drinking cups having a predetermined height;

said housing being generally tubular and having an open lower end defining a bottom edge of predetermined configuration;

said housing comprising an upper portion defining an interior having a minor diameter greater than said predetermined outer diameter of said upper rim of each of said cups, and a lower portion including means for gradually and progrdssively deforming said upper rims into generally elliptic configurations as they are drawn downwardly, said means comprising a pair of opposite lower wall portions engaging said cups at only two diametrically opposed locations and converging so that said lower portion of said housing has a gradually decreasing interior minor diameter which is greater than said predetermined outer diameter above a predetermined point and smaller than said predetermined outer diameter below said predetermined point, said predetermined point being located at a predetermined distance above said bottom edge, said predetermined distance being less than said height of said cups so that the bottom cup in said stack is supported by interference with the housing and has a bottom portion protruding from the lower end of said holder;

each of said opposite lower wall portions having an interior surface that has a radius of curvature greater than that of said cup rims.

3. A drinking cup dispensing system in accordance with claim 2 wherein said interior minor diameter of said housing has its minimum at said bottom edge of said housing.

4. A drinking cup dispensing system in accordance with claim 3 wherein said interior minor diameter of said housing decreases gradually over a distance greater than one half of said predetermined outer diameter of the substantially circular upper rim of each of said drinking cups.

5. A drinking cup dispensing system in accordance with claim 2 wherein said interior minor diameter of said housing decreases over a distance equal to about $\frac{2}{3}$ of said predetermined height of each of said drinking cups.

6. A drinking cup dispensing system in accordance with claim 2 wherein said opposite wall portions contact more than one of said drinking cups in said stack to support the stack.

7. A drinking cup dispensing system in accordance with claim 2 wherein each of said drinking cups has a substantially frustoconical side wall of downwardly decreasing diameter inclined at a first predetermined angle to the axis of the drinking cup over a major portion of its height, and wherein each of said opposite wall portions defining said lower portion of said housing is inclined at a second predetermined angle to the axis of the dispenser, said second predetermined angle being smaller than said first predetermined angle.

8. A drinking cup dispensing system in accordance with claim 3 wherein said lower opposite wall portions of said housing define an angle of about 6° with the axis of the housing.

9. A drinking cup dispensing system comprising:

a stack of plastic drinking cups, each having a substantially circular upper rim of predetermined outer diameter and predetermined circumference; and a holder for supporting said stack of drinking cups and permitting withdrawal thereof one at a time;

said holder comprising a substantially tubular, one-piece molded plastic housing having a continuously curved, substantially elliptic bottom edge having a circumference greater than said predetermined circumference of said cup rim, a major diameter greater than said predetermined diameter of said cup rim, and a minor diameter smaller than said predetermined diameter of said cup rim;

said housing defining an interior having a lower portion of gradually and progressively decreasing cross-sectional area so that said stack is supported by engagement between said stack of drinking cups and said housing near said bottom edge, said stack of cups being deformed by said housing near said bottom edge due to engagement thereby at only a pair of diametrically opposed locations, said housing being much stiffer than said cups so as to be substantially undeformed thereby.

10. A system in accordance with claim 9 wherein said housing is of one-piece, molded plastic construction and comprises an upper portion of substantially C-shaped cross-section and a lower portion of substantially elliptical cross-section.

11. A system in accordance with claim 10 wherein said housing further comprises a mounting portion of substantially rectangular cross-section attached to the rear of said upper portion.

12. A system in accordance with claim 1 further comprising a lid having a generally conical wall covering said upper portion of substantially C-shaped cross-section and a generally rectangular tail covering said mounting portion.

13. A system in accordance with claim 12 further comprising means for pivotally mounting said lid on said housing so that said lid is pivotal about an axis between said generally conical wall and said generally rectangular tail.

14. A system in accordance with claim 7 wherein said housing gradually and progressively deforms a plurality of said cups in unison as said cups travel downwardly therethrough without causing binding between adjacent cups.

15. A system in accordance with claim 9 wherein mulitple cups are held in successive positions by deflection of their rims.

* * * * *